US006422788B1

(12) United States Patent
Hartman

(10) Patent No.: US 6,422,788 B1
(45) Date of Patent: Jul. 23, 2002

(54) HEADWALL FOR DRAIN PIPE

(75) Inventor: Henry B. Hartman, Pittsburgh, PA (US)

(73) Assignee: Hartman EW, Inc., Pittsburgh, PA (US)

( * ) Notice: Subject to any disclaimer, the term of this patent is extended or adjusted under 35 U.S.C. 154(b) by 0 days.

(21) Appl. No.: 09/787,556

(22) PCT Filed: Oct. 18, 1999

(86) PCT No.: PCT/US99/24095

§ 371 (c)(1),
(2), (4) Date: Mar. 19, 2001

(87) PCT Pub. No.: WO00/23664

PCT Pub. Date: Apr. 27, 2000

Related U.S. Application Data

(60) Provisional application No. 60/105,121, filed on Oct. 21, 1998.

(51) Int. Cl.[7] ..... E01F 5/00
(52) U.S. Cl. ..... 405/125
(58) Field of Search ..... 405/124, 125, 405/126, 127, 36, 39, 40, 42, 47

(56) References Cited

U.S. PATENT DOCUMENTS 2,636,352 A * 4/1953 Alger ..... 405/125
D180,410 S * 6/1957 Mowbray ..... D23/259
2,958,200 A * 11/1960 Russell ..... 405/125
3,779,021 A * 12/1973 Green ..... 405/125
5,425,600 A * 6/1995 Gordon ..... 405/125
6,334,953 B1 * 1/2002 Singleton ..... 405/36

FOREIGN PATENT DOCUMENTS

GB 2076867 * 12/1981

* cited by examiner

*Primary Examiner*—Heather Shackelford
*Assistant Examiner*—Frederick L. Lagman
(74) *Attorney, Agent, or Firm*—Webb Ziesenheim Logsdon Orkin & Hanson, P.C.

(57) ABSTRACT

A sectional headwall for a drain pipe includes a unitary base member, at least one unitary sectional member positioned on the base member and a unitary lid member positioned on the at least one sectional member. The unitary base member defines an opening extending therethrough and includes two longitudinally extending walls and two end walls. The base member further includes a sleeve extending between the longitudinal walls that defines an aperture extending through the longitudinal walls for receiving the drain pipe. The sectional member defines an opening therethrough cooperating with the opening defined by the base member.

26 Claims, 4 Drawing Sheets

HEADWALL FOR DRAIN PIPE

This application claims the benefit of U.S. Provisional application No. 60/105,121, filed Oct. 21, 1998.

BACKGROUND OF THE INVENTION

1. Field of the Invention

The present invention relates to headwalls for drain pipes and, more particularly, to sectional headwalls for drain pipes.

2. Description of the Prior Art

The term "headwall" or "end wall" typically refers to a reinforced concrete structure that supports one end of a pipe, such as a drain pipe, and retains earth fill on one side of the structure. The usual technique for constructing concrete headwalls involves the manual preparation of forms made typically of wood or metal and built at the intended headwall location. The forms are stripped away from the concrete after the headwall is formed. The forms are temporary in nature and require a significant amount of labor expense for carpentry and other trades necessary for the manual erection of these forms. Several trips to the headwall construction site are generally required before the concrete headwall is complete.

This prior art headwall construction method has other numerous disadvantages. For example, the headwall construction site is often located in an inaccessible or undeveloped area. The wooden forms most often used to construct the concrete headwall are typically made of heavy wooden planks and plywood sections which are nailed together and are difficult, in practice, to erect in these areas. The forms must be stabilized with timbers, boards and stakes that are driven into the ground at the construction site. This can be difficult, time consuming and labor-intensive at undeveloped sites. In addition, paper or another similar material must be positioned around the drain pipe which extends through the forms to prevent concrete seepage and loss when the forms are filled with concrete. There is usually a pronounced gap in the area around the drain pipe because of the paper positioned around the drain pipe while the concrete cures. Furthermore, the forms must be greased to facilitate their removal after the concrete has hardened. Finally, the poured concrete must be vibrated to remove air voids and the surface of the concrete, when hardened, must be smoothed to remove imperfections left by the forms.

Over the years, attempts have been made to improve the "traditional" prior art method of constructing concrete headwalls discussed hereinabove. For example, U.S. Pat. No. 1,098,766 to Scully et al. discloses a bank retainer for a culvert pipe formed of a plurality of sheet metal plates which are bolted together. In operation, a bottom section of the bank retainer is placed below the culvert pipe and an upper section placed above the culvert pipe. The two sections are then bolted together. Once the sheet metal, box-like structure of the bank retainer is formed, the interior of the bank retainer is filled with earth through an opening in the front of the bank retainer.

U.S. Pat. No. 1,664,503 to Cornell discloses a bulkhead wall for a culvert pipe that includes a series of metal front plates that surround the culvert pipe. The front plates have braces that extend outward into the backfill located behind the bulkhead wall. U.S. Pat. No. 3,779,021 to Green discloses a method of forming a concrete headwall which includes the use of prefabricated forms for concrete. The forms are removable after formation of the concrete headwall.

A more recent attempt to improve the traditional method discussed previously is disclosed by U.S. Pat. No. 4,723,871 to Roscoe. The Roscoe patent discloses a shell-like retainer structure for forming headwalls. The shell-like retainer structure includes two spaced apart plates which each define a U-shaped opening. The plates are centered over a drain pipe with the U-shaped opening defined by the respective plates cooperating with the drain pipe. After the plates are centered over the drain pipe, the structure is filled with earth through an opening formed in the top of the structure.

While each of these references attempts to improve upon the traditional method of forming concrete headwalls, several of the devices disclosed by these references are as heavy, bulky and labor-intensive to use as the concrete forms used in the traditional method. In addition, these devices generally do not provide flexibility in adjusting the height of the headwall. The prior art devices discussed hereinabove typically provide a headwall of a given height which is defined by the height of the device. These devices generally do not provide the ability to alter the height of the headwall in accordance with design parameters for the headwall, such as the terrain at the intended location of the headwall, the amount of backfill that must be retained by the headwall and the size of the drain pipe that is to be used with the headwall. This is a distinct disadvantage because it is common in the art to design the headwall at the construction site without the benefit of engineering the headwall in advance.

Consequently, it is an object of the present invention to provide a headwall that has an adjustable height which may be quickly and easily altered to suit the particular design criteria at the headwall construction site. It is a further object of the present invention to provide a headwall that overcomes the disadvantages of the traditional method of forming concrete headwalls.

SUMMARY OF THE INVENTION

The above objects are accomplished with a sectional headwall system made in accordance with the present invention. The sectional headwall system generally includes a unitary base member, at least one unitary sectional member positioned on top of and connected fixedly to the base member and a unitary lid member positioned on top of and connected fixedly to the at least one sectional member. The base member defines an opening extending therethrough and includes two longitudinally extending walls and two headwalls. The base member includes a sleeve extending between the longitudinal walls and defining an aperture extending through the longitudinal walls. The base member further includes a ground engaging edge for engaging the ground. The at least one sectional member defines an opening extending therethrough cooperating with the opening defined by the base member. A drain pipe extends through the aperture defined by the sleeve. In addition, when the base member is in engagement with the ground along the ground engaging edge of the base member, the headwall defines an internal space configured to receive filler material and bounded by the ground, the base member and the at least one sectional member.

The at least one sectional member may include a plurality of male connecting members and the base member may include a plurality of female connecting members. The male connecting members of the at least one sectional member may cooperate with the female connecting members of the base member to connect the at least one sectional member to the base member. The lid member may include a plurality of male connecting members and the at least one sectional member may further include a plurality of female connecting members. The male connecting members of the lid member may cooperate with the female connecting members of the at least one sectional member to connect the lid member to the at least one sectional member.

The sectional headwall system may further include filler material positioned in the internal space defined by the headwall. The filler material may include earth, sand, aggregate and concrete. The drain pipe may be secured to the sleeve of the base member with fasteners. Preferably, at least one of the base member, the at least one sectional member and the lid member has at least one light reflector attached thereto. The base member, the at least one sectional member and the lid member may be made of light absorbing and emitting plastic. A recess may be formed in the lid member and a light reflective delineator bar may be supported in the recess. Furthermore, the base member may further include a frangible cover plate covering the aperture at each of the longitudinal walls of the base member.

In an alternative embodiment of the sectional headwall system according to the present invention, the sleeve extending between the longitudinal walls of the base member may be formed along the ground engaging edge of the base member. The sleeve may define a sleeve opening configured to cooperate with the drain pipe. A method of forming a sectional headwall system is also part of the present invention.

Further details and advantages of the present invention will become apparent in the following detailed description, in conjunction with the drawings wherein like reference numerals designate like parts throughout.

DETAILED DESCRIPTION OF THE PREFERRED EMBODIMENTS

Figure 1:
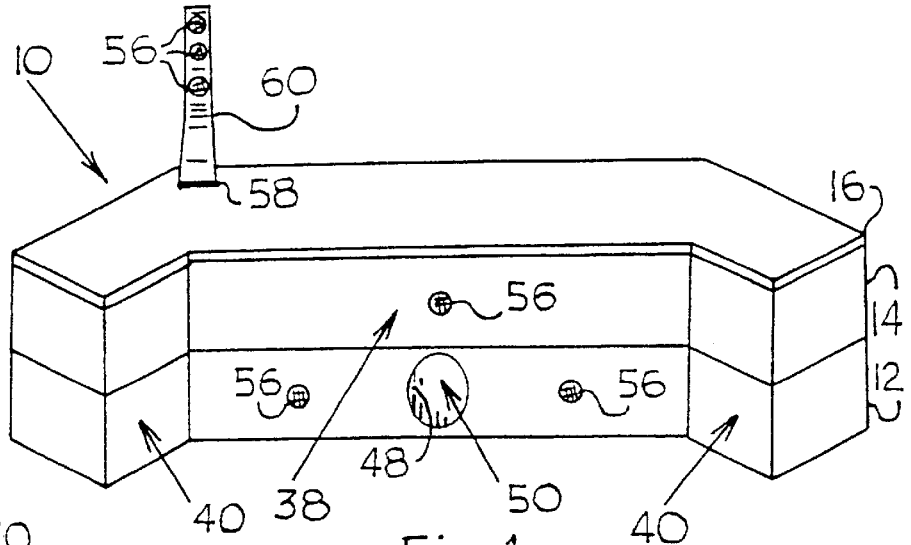
FIG. 1 is a perspective view of a headwall for a drain pipe in accordance with the present invention.
Figure 2:
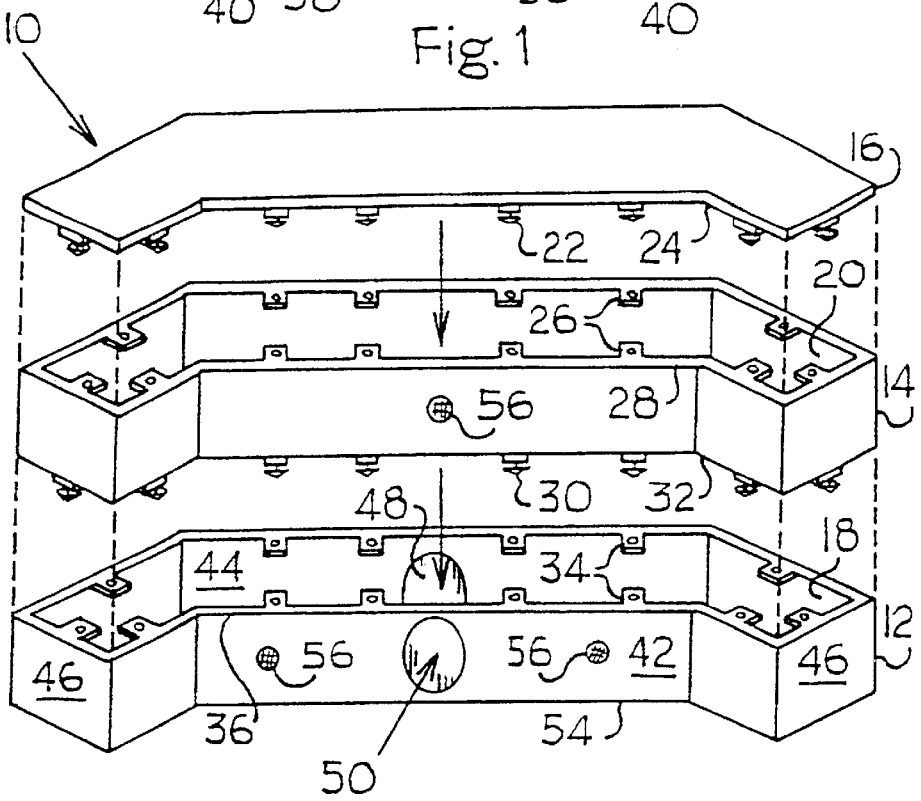
FIG. 2 is an exploded, perspective view of the headwall shown on FIG. 1.

FIGS. 1 and 2 generally show a headwall or end wall 10 made in accordance with the present invention. The headwall 10 generally includes a unitary base member 12, at least one unitary sectional member 14 positioned on top of the base member 12 and a unitary lid member 16 positioned on top of the sectional member 14. The base member 12 and the sectional member 14 are formed as hollow shell structures each defining an opening extending therethrough and designated with reference numbers 18, 20, respectively. The base member 12, the sectional member 14 and the lid member 16 are preferably made of plastic such as polypropylene, polyethylene, polyvinyl chloride and polyurethane. Consequently, the base member 12, the sectional member 14 and the lid member 16 are relatively light in weight and can be easily manipulated by one person.

The lid member 16 is connected securely to the sectional member 14 located below the lid member 16. Similarly, the sectional member 14 is connected securely to the base member 12 located below the sectional member 14. In the preferred embodiment, the lid member 16 includes a plurality of male connecting members 22 formed along a bottom edge 24 of the lid member 16. The male connecting members 22 depending from the lid member 16 are configured to cooperate with a plurality of female connecting members 26 formed along a top edge 28 of the sectional member 14. The sectional member 14 further includes a plurality of male connecting members 30 formed along a bottom edge 32 of the sectional member 14. The male connecting members 30 depending from the sectional member 14 are configured to cooperate with a plurality of female connecting members 34 formed along a top edge 36 of the base member 12. The male connecting members 22, 30 are preferably formed as arrow-shaped projections having barbs which retain the male connecting members 22, 30 in engagement with the respective female connecting members 26, 34 after the male connecting members 22, 30 are placed in engagement with the female connecting members 26, 34. The male-female connecting member "snap fit" arrangement discussed hereinabove is merely illustrative of one type of connection for securing the lid member 16 to the sectional member 14 and for securing the sectional member 14 to the base member 12 to form the headwall 10. Other fastening schemes such as a simple tongue-in-groove "friction fit" arrangement are envisioned by the present invention. Alternatively, the lid member 16 may be secured to the sectional member 14 and the sectional member 14 secured to the base member 12 with simple straps or brackets (not shown). The straps or brackets may be positioned internally within the headwall 10 or positioned externally on the outer surface of the headwall 10 and extend between the various members comprising the headwall 10.

Figure 5:
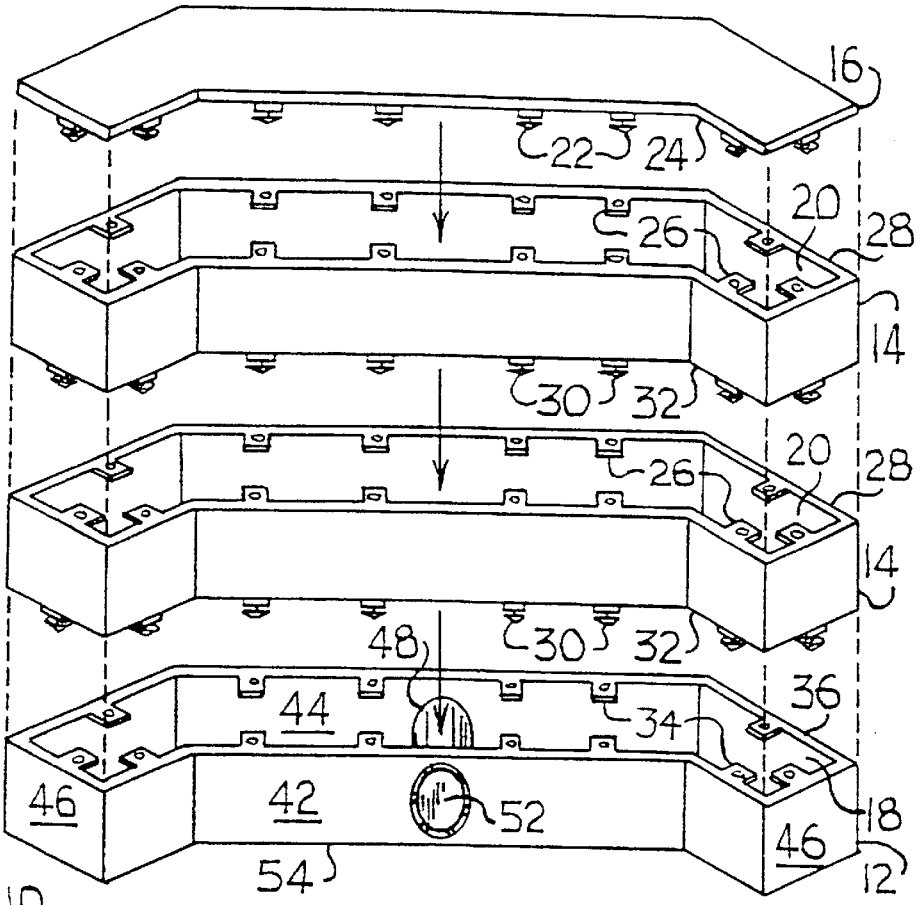
FIG. 5 is a perspective view of the headwall of FIG. 1 showing the headwall with a plurality of sectional members.

While only one sectional member 14 is shown with the headwall 10 in FIGS. 1 and 2, it will be apparent that the headwall 10 may include a plurality of stacked sectional members 14 as shown in FIG. 5 discussed hereinafter. In addition, the headwall 10 shown in the figures is generally comprised of a rectangular center section 38 with two angled portions 40 at the ends of the rectangular section 38. However, it will be apparent to those skilled in the art that the headwall 10 may have any shape customary in the art, such as square, rectangular or semi-circular, with the base member 12, the sectional member 14 and the lid member 16 each formed to the intended shape of the headwall 10.

Referring now to FIGS. 1–5, the base member 12 is generally defined by two longitudinally extending walls 42, 44 and two end walls 46. A sleeve 48 extends between the longitudinal walls 42, 44. The sleeve 48 is located in the opening 18 defined by the base member 12. The sleeve 48 defines an aperture 50 extending through the longitudinal walls 42, 44 for receiving a drain pipe (not shown). The drain pipe will extend through the sleeve 48 and project outward from the longitudinal walls 42, 44 of the base member 12. The aperture 50 defined by the sleeve 48 may be covered at each of the longitudinal walls 42, 44 by a frangible cover plate 52, as shown in FIG. 5. The respective cover plates 52 are formed integrally as part of the base member 12 and are intended to be broken out and removed before the drain pipe is extended through the aperture 50 defined by the sleeve 48. As an alternative to the cover plate 52 arrangement shown in FIG. 5, the longitudinal wails 42, 44 of the base member 12 may be formed to cover the aperture 50 and be made thinner at the intended location for the aperture 50. The drain pipe may then be used to puncture the longitudinal walls 42, 44 of the base member 12 so that the aperture 50 is formed through the longitudinal walls 42, 44.

The base member 12 further includes a ground engaging or bottom edge 54 for engaging the ground. The base member 12 and the sectional member 14 shown in FIGS. 1–4 will each typically be 1–2 feet high, although they could be higher depending on pipe size and other factors. As shown in FIG. 5, multiple sectional members 14 may be added on top of the base member 12 allowing the height of the headwall 10 to be adjusted to suit the particular headwall construction requirements at hand. In particular, the sectional members 14 will be stacked one on top of the other between the lid member 16 and the base member 12. Each of the sectional members 14 shown in FIG. 5 will typically be 1–2 feet high.

Figure 3:
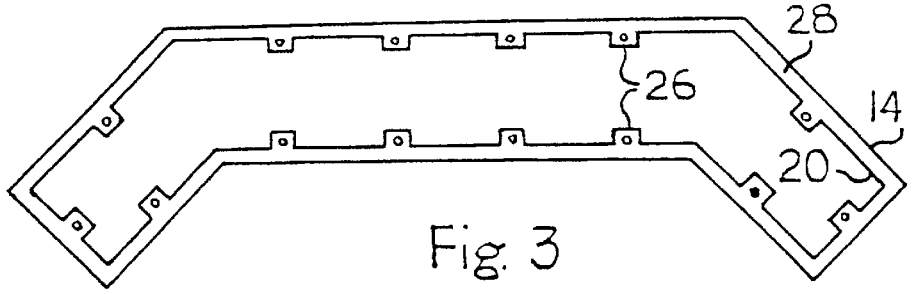
FIG. 3 is a top plan view of a sectional member of the headwall shown in FIG. 1.
Figure 4:
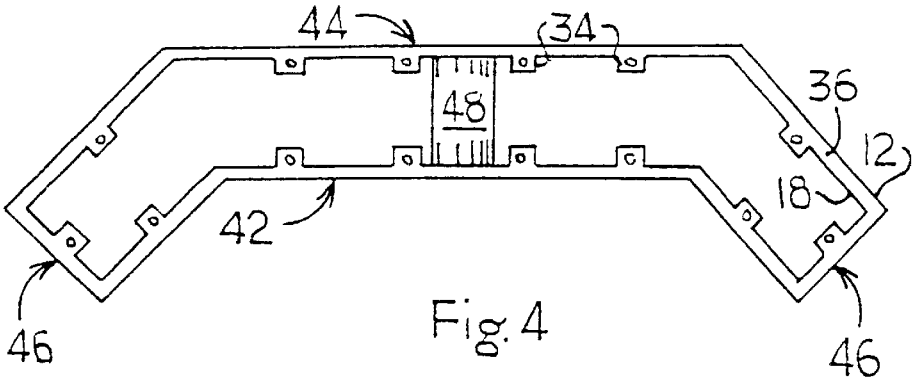
FIG. 4 is a top plan view of a base member of the headwall shown in FIG. 1.

Referring in particular to FIGS. 3 and 4, the openings 18, 20 defined, respectively, by the base member 12 and the sectional member 14, extend vertically through the base member 12 and the sectional member 14. In addition, the female connecting members 26, 34 connected to the sectional member 14 and the base member 12, respectively, are shown in greater detail in FIGS. 3 and 4.

Referring again to FIGS. 1–5, the headwall 10 may include light reflectors 56 attached to the base member 12, the sectional member 14 and the lid member 16 to improve the visibility of the headwall 10 for safety, especially at night. The light reflectors 56 may be provided as reflective plastic discs or reflective strips adhered to the surface of the base member 12, the sectional member 14 and the lid member 16. The present invention also envisions that the base member 12, the sectional member 14 and the lid member 16 may be made of plastic which has light absorbing and entitling properties for enhanced visibility, especially at night. Furthermore, the lid member 16 may be formed with a recess 58 configured to receive a light reflective delineator bar 60. The delineator bar 60 has one end positioned and supported in the recess 44 and may include light reflectors 56 attached thereto. The delineator bar 60 extends upward from the headwall 10 and may serve as a marker to identify the headwall 10. Characteristic information about the headwall 10 may be imprinted on the delineator bar 60.

Figure 6:
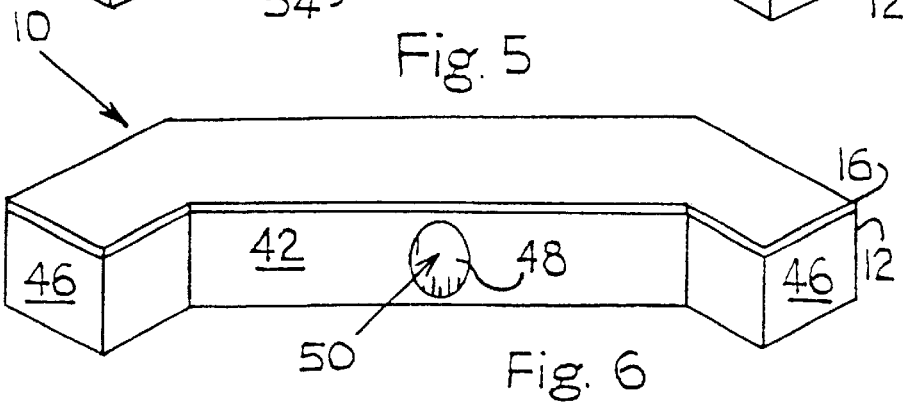
FIG. 6 is a perspective view of the headwall of FIG. 1 showing a lid member attached directly to the base member of the headwall.

FIG. 6 illustrates an embodiment of the headwall 10 in which the sectional member 14 is omitted entirely and the lid member 16 connects directly to the base member 12. In this embodiment of the headwall 10, the male connecting members 22 depending from the lid member 16 cooperate directly with the female connecting members 34 formed along the top edge 36 of the base member 12. The male connecting members 22 and the female connecting members 34 are shown in FIG. 2. The embodiment of the headwall 10 shown in FIG. 6 is suitable for low lying areas where only minimal backfill is necessary or where a taller headwall 10 would be impractical or unnecessary.

Figure 7:
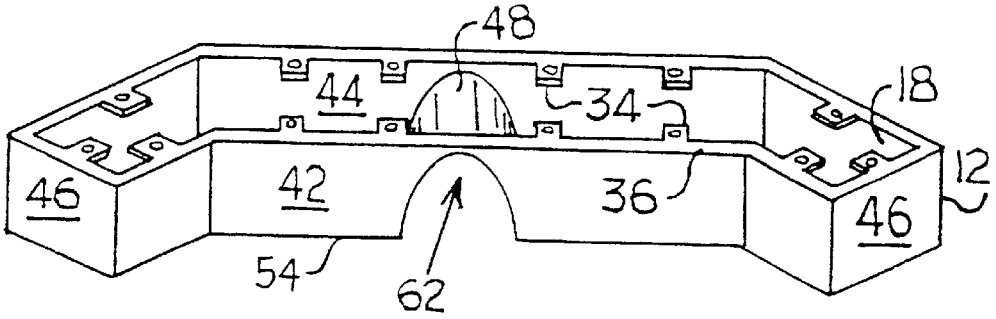
FIG. 7 is a perspective view of an alternative embodiment of the base member of the headwall shown in FIG. 1.

An alternative embodiment of the base member 12 is shown in FIG. 7. The alternative embodiment of the base member 12 locates the sleeve 48 along the ground engaging edge 54 of the base member 12 such that the sleeve 48 defines a semi-circular or U-shaped sleeve opening 62 along the ground engaging edge 54. The sleeve opening 62 is configured to be cooperate with a drain pipe (not shown) The base member 12 shown in FIG. 7 is similar in all other aspects to the base member 12 discussed hereinabove except for the location and formation of the sleeve 48.

Figure 8:
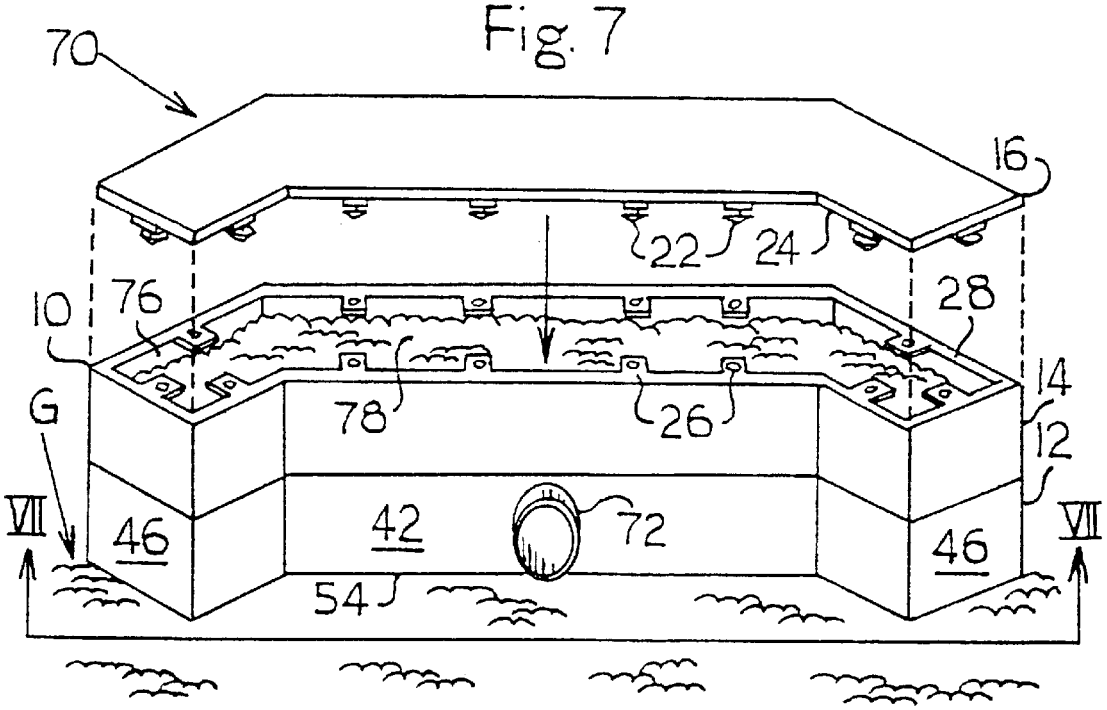
FIG. 8 is a partially exploded, perspective view of the headwall of FIG. 1 showing aggregate positioned within the headwall.
Figure 9:
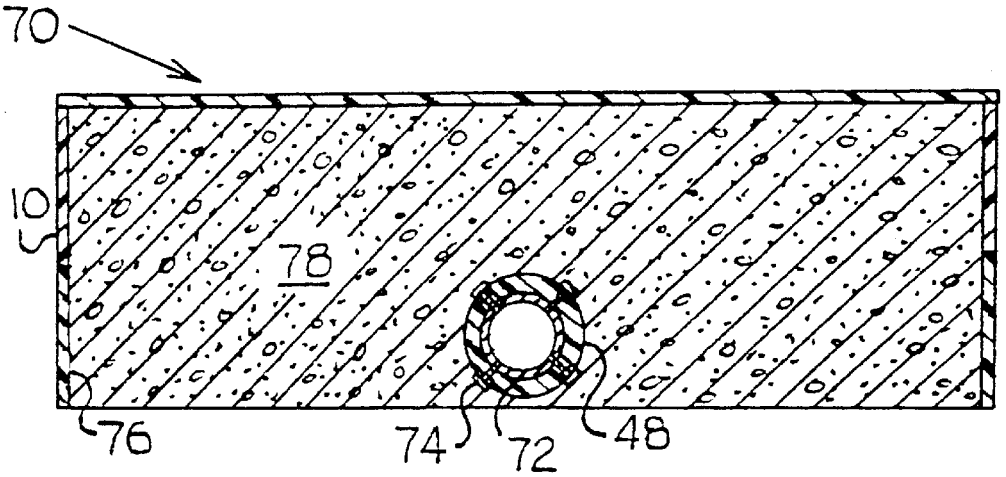
FIG. 9 is a cross-sectional view of the headwall shown in FIG. 8.
Figure 11:
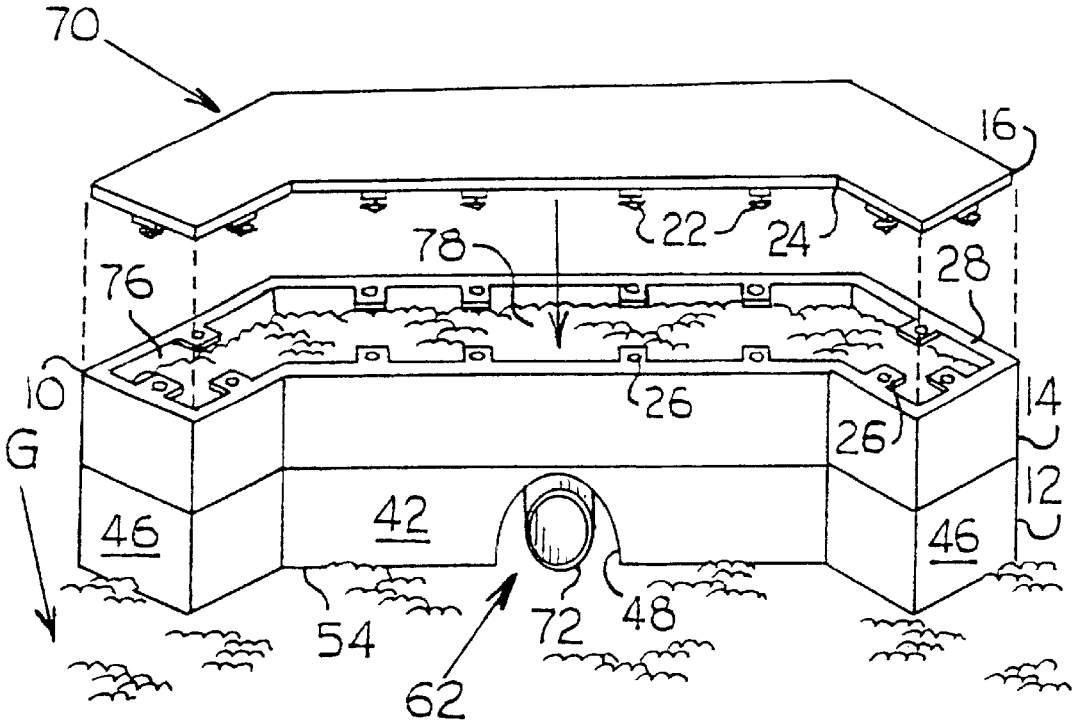
FIG. 11 is a partially exploded, perspective view of the headwall of FIG. 1 showing the headwall with the alternative embodiment of the base member shown in FIG. 7.

Referring to FIGS. 8–11, the present invention is also a sectional end wall system 70 for a drain pipe 72. The system 70 generally includes the headwall 10 discussed previously having the base member 12, the at least one sectional member 14, the lid member 16, and further includes the drain pipe 72. In use, the base member 12 of the headwall 10 is in contact with the ground along the ground engaging edge 54 of the base member 12. The ground is designated with reference character G in FIGS. 8, 10 and 11. The sectional member 14 is positioned on and engaged securely with the base member 12. The lid member 16 is positioned on and engaged securely with the sectional member 14. The drain pipe 72 extends through aperture 50 defined by the sleeve 48. The drain pipe 72, as shown in FIG. 9, is preferably secured to the sleeve 48 with mechanical fasteners 74, such as metal or plastic nuts, bolts or screws. In use, the headwall 10 of the system 70 generally defines an internal space 76 bounded by the ground G, the base member 12 and the sectional member 14. The sectional end wall system 70 generally further includes filler material 78 positioned within the internal space 76 defined by the headwall 10. Suitable materials for the filler material 78 include earth, sand, aggregate, concrete and other materials customary in the art. The internal space 76 is preferably entirely filled with the filler. material 78 as shown in FIGS. 8, 9 and 11.

Figure 10:
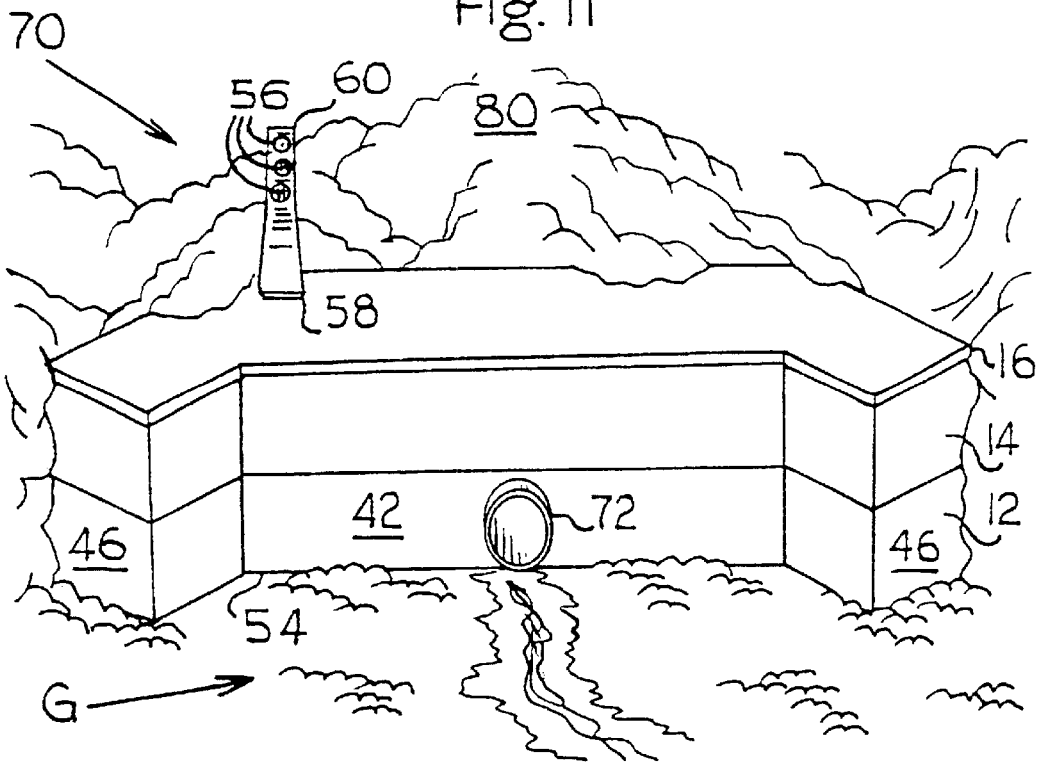
FIG. 10 is a perspective view of the headwall of FIG. 1 showing the headwall retaining backfill.

With reference to FIGS. 1–10, the sectional end wall system 70 is constructed as discussed hereinafter. The base member 12 is positioned at the intended headwall construction site with the ground engaging edge 54 of the base member 12 positioned against the ground G. The drain pipe 72 is then extended through the aperture 50 defined by the sleeve 48. At least one sectional member 14 is positioned on top of the base member 12 and engaged securely with the underlying base member 12. If additional sectional members 14 are required, they are stacked upon the underlying sectional member 14. The internal space 76 defined by the ground G, the base member 12 and the at least one sectional member 14 is then filled with the filler material 78, such as aggregate. The sleeve 48 advantageously protects the drain pipe 72 from damage as the headwall 10 is filled with the filler material 78. Prior to filling the internal space 76 defined by the headwall 10 with the filler material 78, the drain pipe 72 may be affixed to the sleeve 48 of the base member 12 with fasteners 74. The fixed connection between the drain pipe 72 and the sleeve 48 provided by the fasteners 74 enhances the stability of the headwall 10 as will be appreciated by those skilled in the art. The lid member 16 is then placed on top of and engaged securely with the sectional member 14 thereby completing the headwall 10 and enclosing the internal space 76. The area behind the headwall 10 may then be backfilled with earth, rock or other fill material 80 as shown in FIG. 10. The headwall 10 serves to support the drain pipe 72 and retain the earth fill 80 located behind the headwall 10. The system 70 shown in FIG. 11 incorporates the alternative embodiment of the base member 12 shown in FIG. 7 and is constructed in a similar manner to the process described hereinabove.

The present invention provides a lightweight sectional headwall 10 and a sectional headwall system 70 that overcome the disadvantages discussed previously in connection with the traditional method of forming concrete headwalls. The sectional headwall 10 of the present invention provides an adjustable height headwall that quickly and easily forms a headwall without the use or heavy and labor-intensive concrete forms, or their equivalents generally known in the prior art. The height of the sectional headwall 10 of the present invention can be quickly adjusted on site by adding or subtracting sectional members 14. The sleeve 48 of the base member 12 of the headwall 10 provides added protection for the drain pipe 72 when the headwall 10 is filled with filler material 78. Furthermore, the addition of light reflectors 56 and/or a delineator bar 60 and the use of light absorbing and emitting plastic enhance the safety aspects of the sectional headwall 10 and the sectional headwall system 70 of the present invention. Finally, the use of a plastic headwall 10 filled with aggregate, sand or earth provides a secondary benefit that the headwall 10 will collapse and absorb energy during an impact with an automobile, further enhancing the safety aspects of the present invention.

The invention has been described with reference to preferred embodiments which are merely illustrative of the present invention and not restrictive thereof. Obvious modifications and alterations of the present invention may be made without departing from the spirit and scope of the present invention. The scope of the present invention is defined by the appended claims and equivalents thereto.

What is claimed is:

1. A sectional headwall for a drain pipe, comprising:

a unitary base member defining an opening extending therethrough and having two longitudinally extending walls and two end walls, with the base member further including a sleeve extending between the longitudinal walls and defining an aperture extending through the longitudinal walls for receiving the drain pipe;

at least one unitary sectional member positioned on top of and connected fixedly to the base member, with the at least one sectional member defining an opening extending therethrough cooperating with the opening defined by the base member; and a unitary lid member positioned on top of and connected fixedly to the at least one sectional member.

2. The sectional headwall of claim 1, wherein the at least one sectional member includes a plurality of male connecting members and the base member includes a plurality of female connecting members, wherein the male connecting members of the at least one sectional member cooperate with the female connecting members of the base member to connect the at least one sectional member to the base member, wherein the lid member includes a plurality of male connecting members and the at least one sectional member further includes a plurality of female connecting members, and wherein the male connecting members of the lid member cooperate with the female connecting members of the at least one sectional member to connect the lid member to the at least one sectional member.

3. The sectional headwall of claim 1, wherein at least one of the base member, the at lease one sectional member and the lid member has at least one light reflector attached thereto.

4. The sectional headwall of claim 1, wherein the base member, the at least one sectional member and the lid member are made of light absorbing and emitting plastic.

5. The sectional headwall of claim 1, wherein a recess is formed in the lid member, and wherein a light reflective delineator bar is supported in the recess.

6. The sectional headwall of claim 1, wherein the sleeve extending between the longitudinal walls of the base member is formed along a ground engaging edge of the base member, and wherein the sleeve defines a sleeve opening configured to cooperate with the drain pipe.

7. The sectional headwall of claim 1, wherein the base member further includes a frangible cover plate covering the aperture at each of the longitudinal walls of the base member.

8. A sectional headwall system, comprising:

a sectional headwall further including:

a unitary base member defining an opening extending therethrough and having two longitudinally extending walls and two end walls, with the base member further including a sleeve extending between the longitudinal walls and defining an aperture extending through the longitudinal walls, and with the base member further having a ground engaging edge for engaging the ground;

at least one unitary sectional member positioned on top of and connected fixedly to the base member, with the at least one sectional member defining an opening extending therethrough cooperating with the opening defined by the base member; and a unitary lid member positioned on top of and connected fixedly to the at least one sectional member; and a drain pipe extending through the aperture defined by the sleeve, wherein when the base member is in engagement with the ground along the ground engaging edge of the base member the headwall defines an internal space configured to receive filler material, and wherein in the internal space is by the ground, the base member and the at least one sectional member.

9. The sectional headwall system of claim 8, wherein the at least one sectional member includes a plurality of male connecting members and the base member includes a plurality of female connecting members, wherein the male connecting members of the at least one sectional member cooperate with the female connecting members of the base member to connect the at least one sectional member to the base member, wherein the lid member includes a plurality of male connecting members and the at least one sectional member further includes a plurality of female connecting members, and wherein the male connecting members of the lid member cooperate with the female connecting members of the at least one sectional member to connect the lid member to the at least one sectional member.

10. The sectional headwall system of claim 8, further including filler material positioned in the internal space defined by the headwall.

11. The sectional headwall system of claim 9, wherein the filler material includes one of earth, sand, aggregate and concrete.

12. The sectional headwall system of claim 8, wherein the drain pipe is secured to the sleeve of the base member with fasteners.

13. The sectional headwall system of claim 8, wherein at least one of the base member, the at least one sectional member and the lid member has at least one light reflector attached thereto.

14. The sectional headwall system of claim 8, wherein the base member, the at least one sectional member and the lid member are made of light absorbing and emitting plastic.

15. The sectional headwall system of claim 8, wherein a recess is formed in the lid member, and wherein a light reflective delineator bar is supported in the recess.

16. The sectional headwall system of claim 8, wherein the sleeve extending between the longitudinal walls of the base member is formed along the ground engaging edge of the base member, and wherein the sleeve defines a sleeve opening configured to cooperate with the drain pipe.

17. The sectional headwall system of claim 8, wherein the base member further includes a frangible cover plate covering the aperture at each of the longitudinal walls of the base member.

18. A method of constructing a sectional end wall system, comprising the steps of:

providing a sectional headwall having a base member, at least one sectional member and a lid member, with the base member having a ground engaging edge for engaging the ground;

positioning the base member in engagement with the ground along the ground edge of the base member, with the base member defining an opening extending therethrough and having two longitudinally extending walls and two end walls, and with the base member having a sleeve extending between the longitudinal walls and defining an aperture extending through the longitudinal walls;

extending a drain pipe through the aperture defined by the sleeve;

positioning the at least one sectional member on top of the base member, with the sectional member defining an opening extending therethrough cooperating with the opening defined by the base member, wherein the headwall defines an internal space configured to receive filler material, and wherein the internal space is defined by the ground, the base member and the at least one sectional member;

filling the internal space defined by the headwall with the filler material; and positioning the lid member on the at least one sectional member such that the headwall is formed and the internal space is enclosed.

19. The method of claim 18, further including the step of securing the drain pipe to the sleeve of the base member with fasteners.

20. The method of claim 18, further including the step of attaching at least one light reflector to at least one of the base member, the sectional member and the lid member.

21. A headwall for a drain pipe, comprising:

a unitary base member defining an opening extending therethrough and having two longitudinally extending walls and two end walls, with the base member further including a sleeve extending between the longitudinal walls and defining an aperture extending through the longitudinal walls for receiving the drain pipe; and a unitary lid member positioned on top of and connected fixedly to the base member, wherein the base member includes a plurality of female connecting members, wherein the lid member includes a plurality of male connecting members, and wherein the male connecting members of the lid member cooperate with the female connecting members of the base member to connect the lid member to the base member.

22. The headwall of claim 21, wherein at least one of the base member and the lid member has at least one light reflector attached thereto.

23. The headwall of claim 21, wherein the base member and the lid member are made of light absorbing and emitting plastic.

24. The headwall of claim 21, wherein a recess is formed in the lid member, and wherein a light reflective delineator bar is supported in the recess.

25. The headwall of claim 21, wherein the sleeve extending between the longitudinal walls of the base member is formed along a ground engaging edge of the base member, and wherein the sleeve defines a sleeve opening configured to cooperate with the drain pipe.

26. The headwall of claim 21, wherein the base member further includes a frangible cover plate covering the aperture at each of the longitudinal walls of the base member.

* * * * *

UNITED STATES PATENT AND TRADEMARK OFFICE

CERTIFICATE OF CORRECTION

PATENT NO. : 6,422,788 B1
DATED : July 23, 2002
INVENTOR(S) : Henry B. Hartman

It is certified that error appears in the above-identified patent and that said Letters Patent is hereby corrected as shown below:

Column 5,
Line 46, “entitling” should read -- emitting --.

Column 6,
Line 7, after “shown)” insert -- . --.
Line 34, after “filler” delete “.”.

Column 7,
Line 7, “of” should read -- or --.
Line 62, “lease” should read -- least --.

Signed and Sealed this

Thirty-first Day of December, 2002

JAMES E. ROGAN
*Director of the United States Patent and Trademark Office*